US012575685B2

(12) United States Patent
Park

(10) Patent No.: US 12,575,685 B2
(45) Date of Patent: Mar. 17, 2026

(54) CORE SUPPORT AND MATTRESS USING THE SAME

(71) Applicant: Young Hoon Park, Seoul (KR)

(72) Inventor: Young Hoon Park, Seoul (KR)

( * ) Notice: Subject to any disclaimer, the term of this patent is extended or adjusted under 35 U.S.C. 154(b) by 0 days.

(21) Appl. No.: 19/262,259

(22) Filed: Jul. 8, 2025

(65) Prior Publication Data

US 2026/0060443 A1 Mar. 5, 2026

(30) Foreign Application Priority Data

Aug. 27, 2024 (KR) ..... 10-2024-0115119

(51) Int. Cl.
*A47C 27/14* (2006.01)
*A47C 27/15* (2006.01)

(52) U.S. Cl.
CPC ..... *A47C 27/146* (2013.01); *A47C 27/15* (2013.01)

(58) Field of Classification Search
CPC ..... A47C 27/146; A47C 27/15; A47C 27/14; A47C 27/142; A47C 27/148; A47C 27/144; A47C 27/20
See application file for complete search history.

(56) References Cited

U.S. PATENT DOCUMENTS 2,763,013 A * 9/1956 Van Valkenburgh ..... A47C 27/146 5/699
3,191,197 A * 6/1965 Frey ..... A47C 27/146 5/241
3,298,046 A * 1/1967 Clementi ..... A47C 7/18 297/452.48
3,731,327 A * 5/1973 Frey ..... A47C 19/005 5/722
6,941,603 B2 * 9/2005 Radice ..... A47C 27/144 5/636
2010/0005594 A1 * 1/2010 Rancourt ..... A47C 27/144 5/655.5
2015/0289669 A1 * 10/2015 Reynolds ..... A47C 27/144 5/690

FOREIGN PATENT DOCUMENTS

JP 2749462 B2 5/1998
JP 3564598 B2 9/2004
KR 10-1715566 B1 3/2017
KR 10-2018-0049627 A 5/2018

OTHER PUBLICATIONS

Office Action issued Sep. 27, 2024 in Korean Application No. 10-2024-0115119.
Notice of Allowance issued Feb. 18, 2025 in Korean Application No. 10-2024-0115119.

* cited by examiner

*Primary Examiner* — Matthew Troutman
*Assistant Examiner* — Alison N Labarge
(74) *Attorney, Agent, or Firm* — Sughrue Mion, PLLC

(57) ABSTRACT

The present invention relates to a core support and a mattress using the same and includes a base foam formed of an elastically deformable material and a plurality of support blocks seated on an upper surface of the base foam and formed of a vertically elastically deformable material.

3 Claims, 10 Drawing Sheets

[FIG. 1]
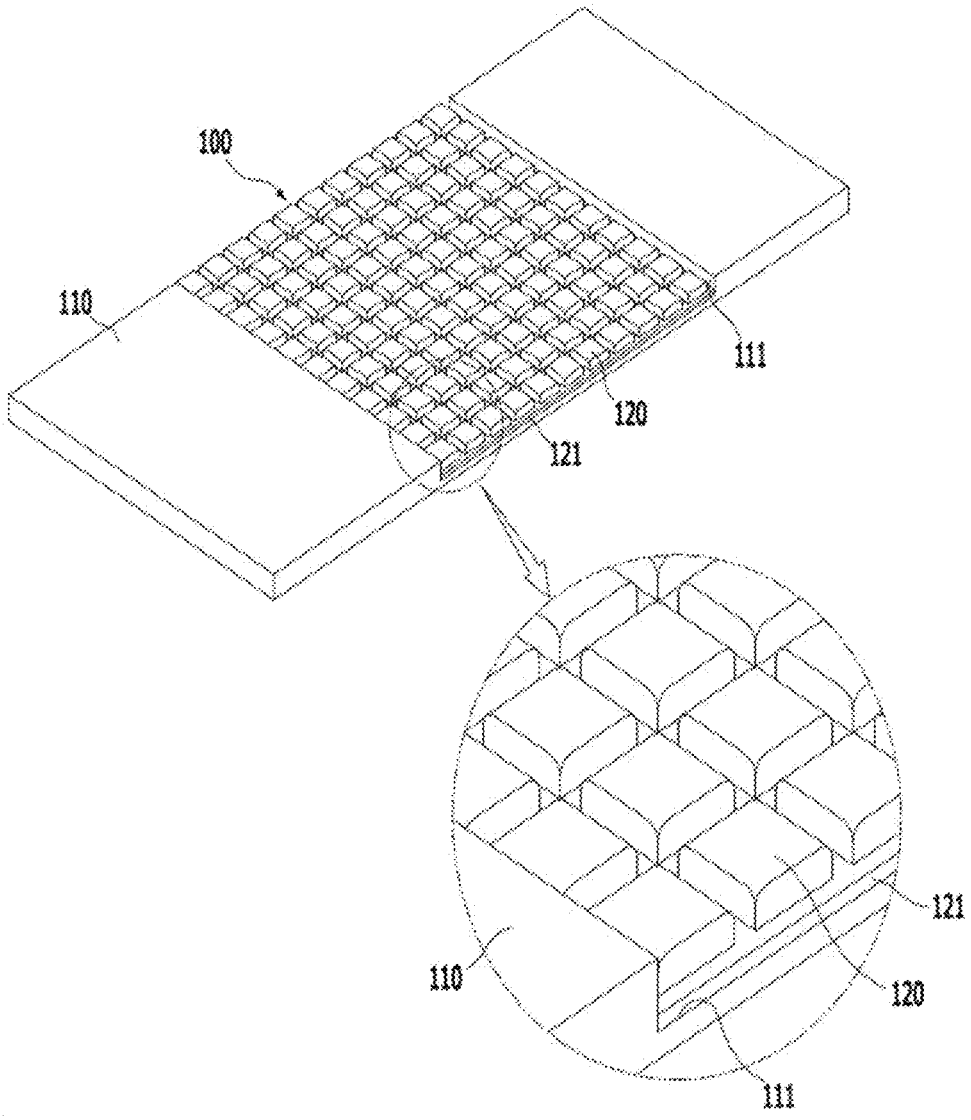

[FIG. 2]
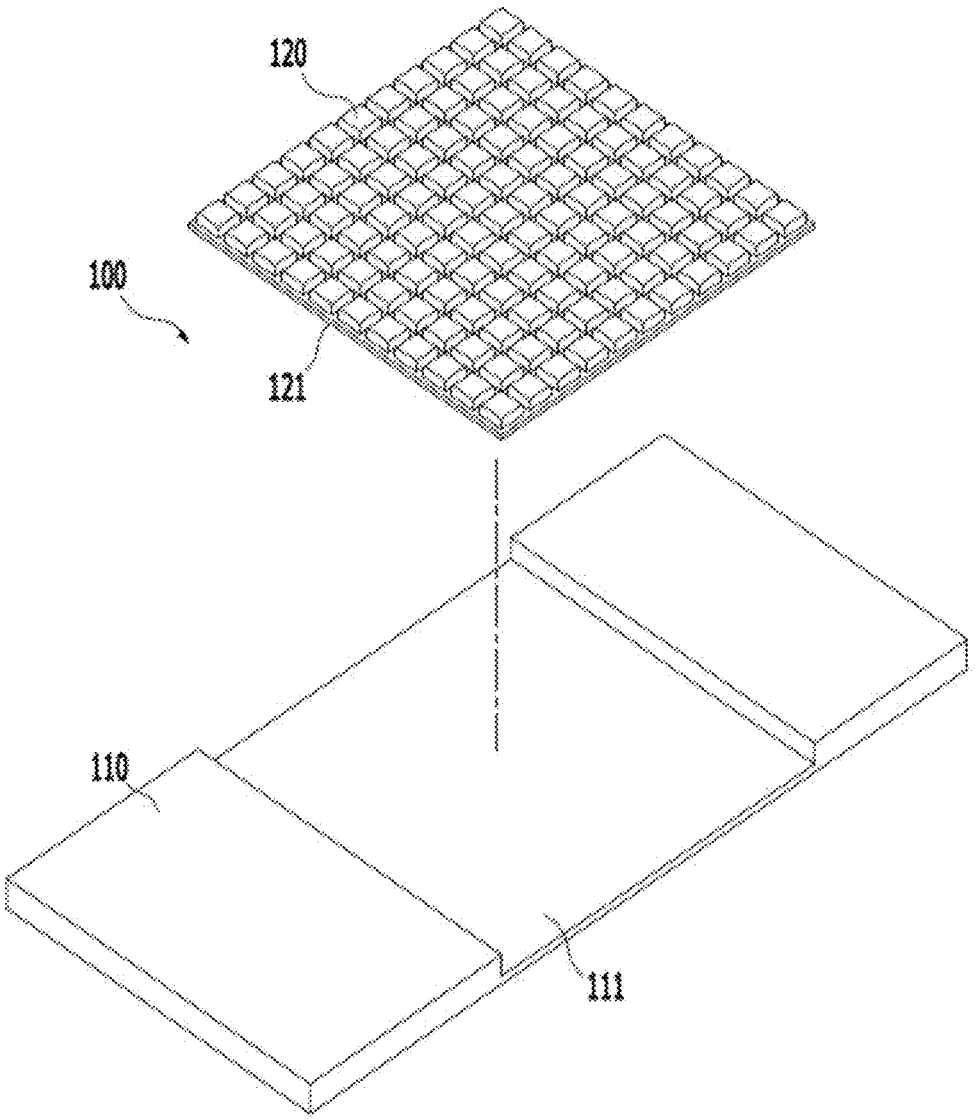

[FIG. 3]
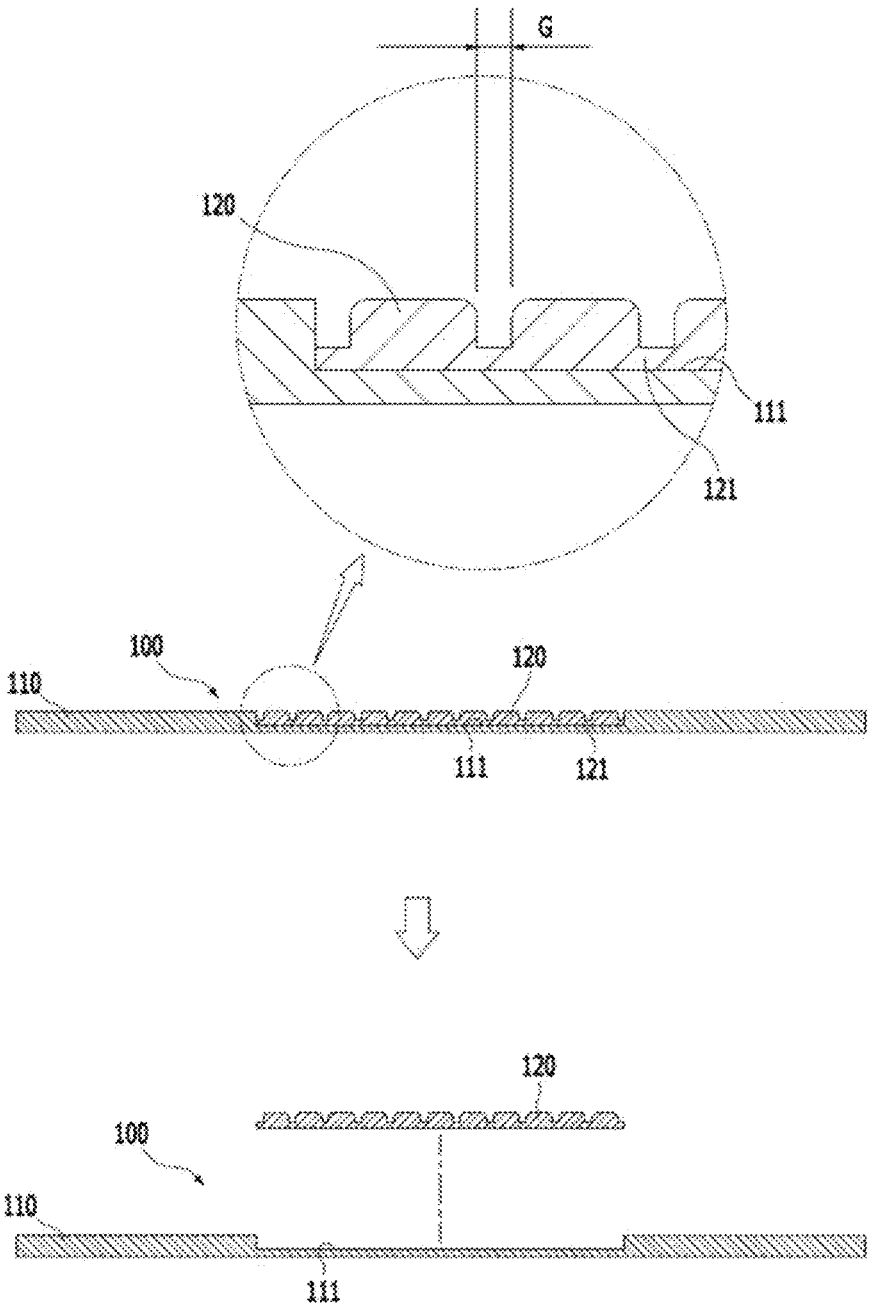

[FIG. 4]
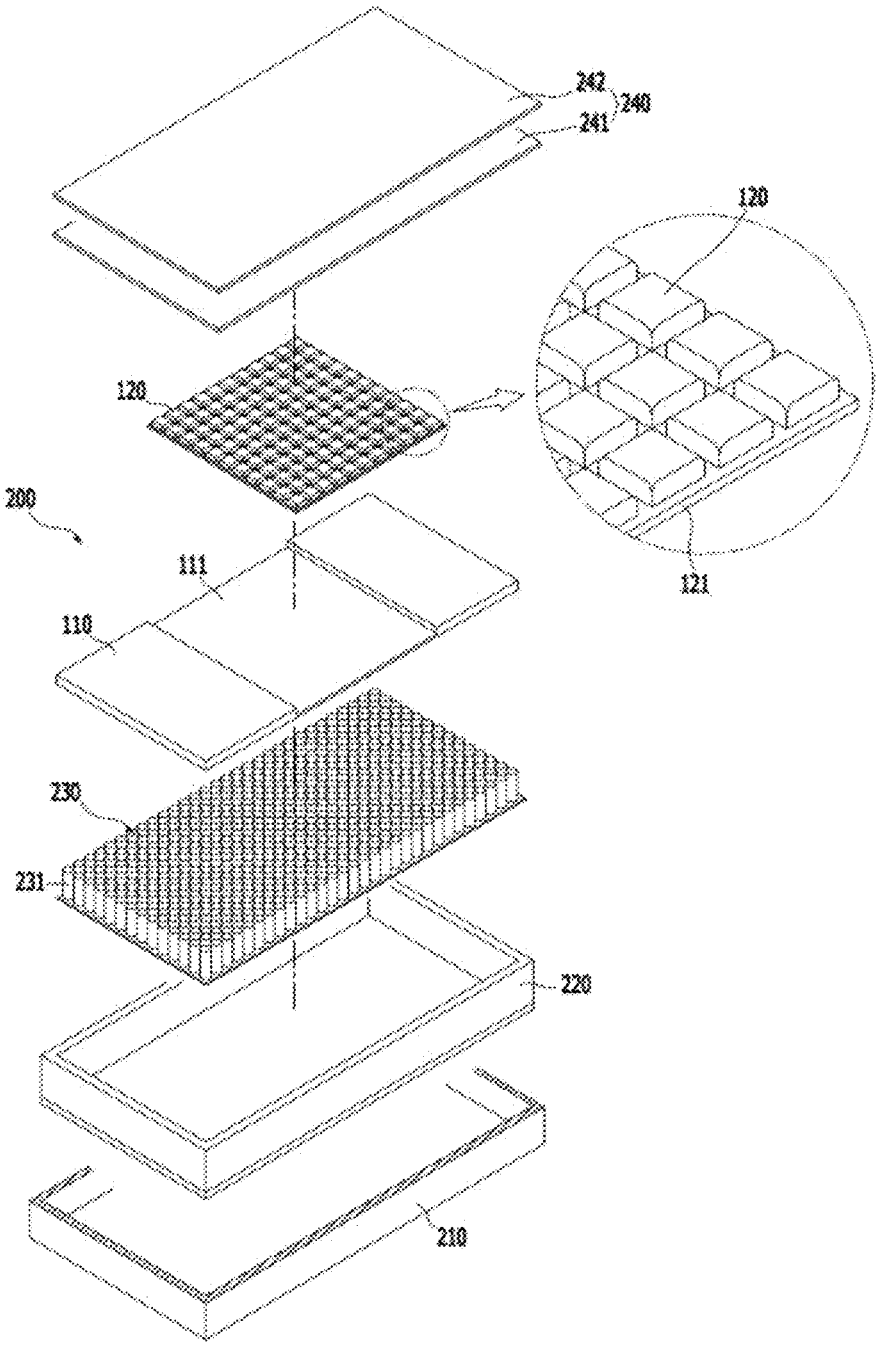

[FIG. 5]
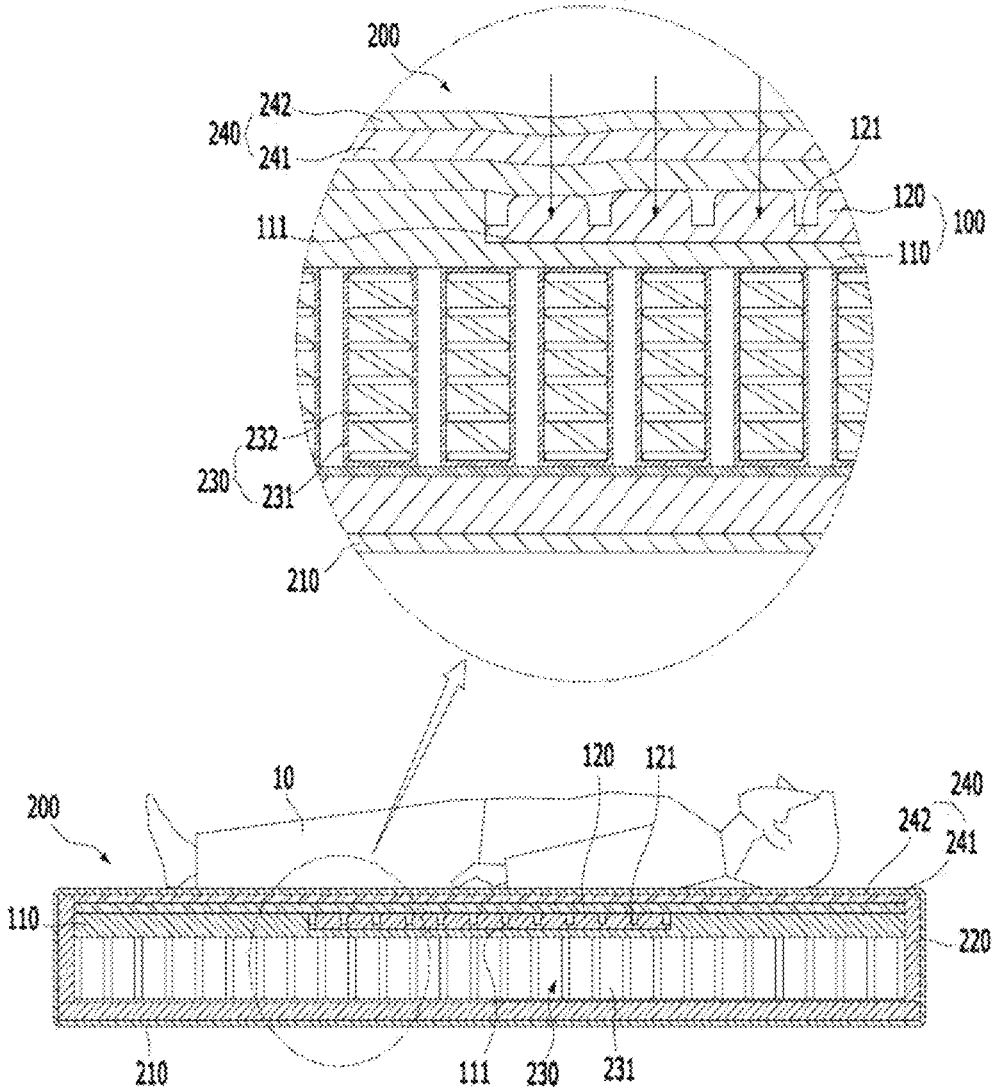

[FIG. 6]
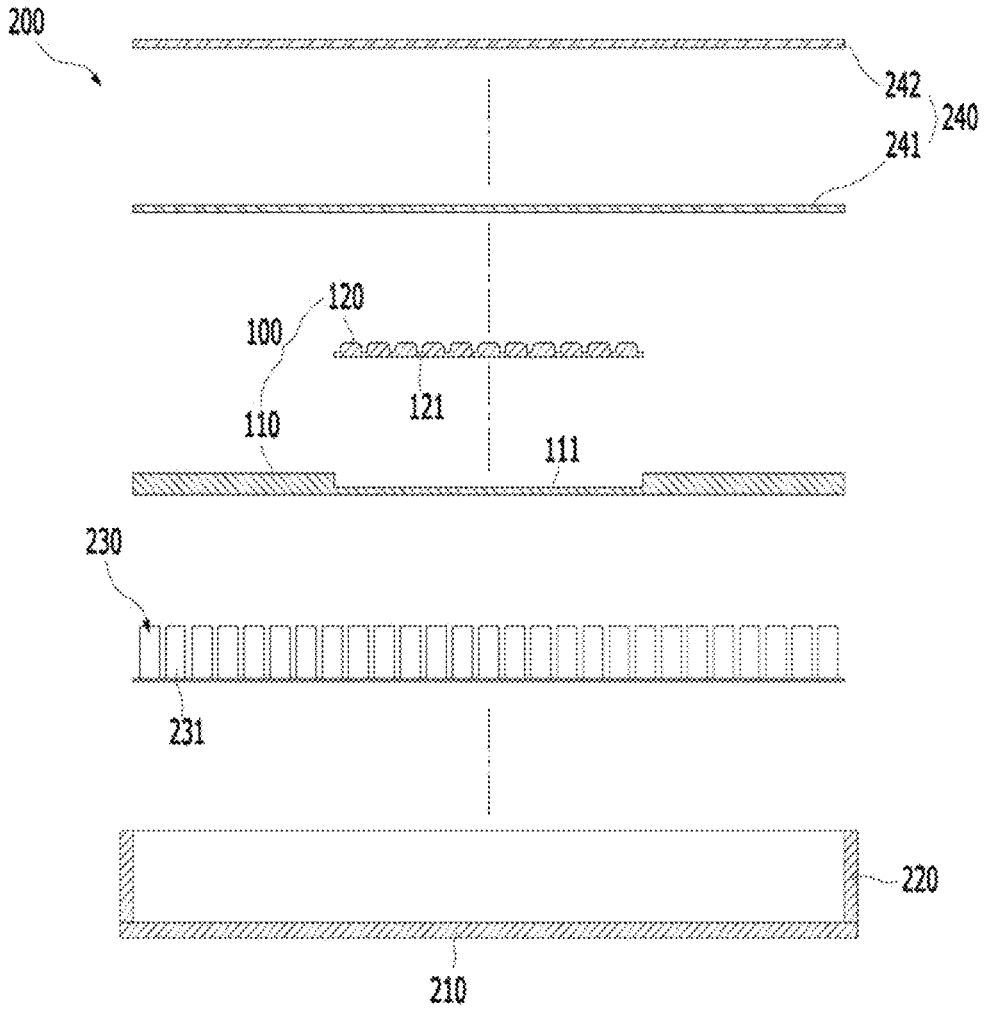

[FIG. 7]
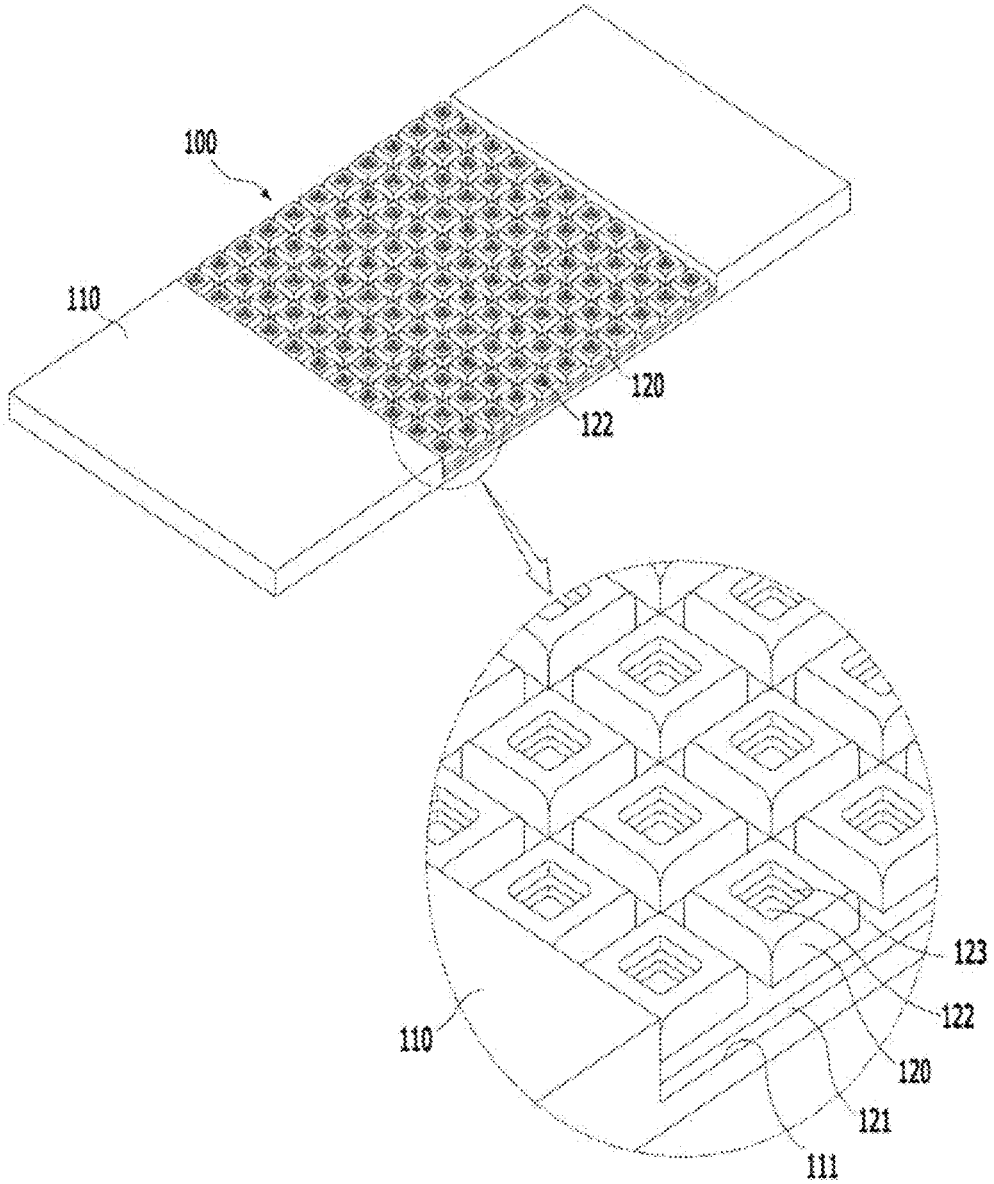

[FIG. 8]
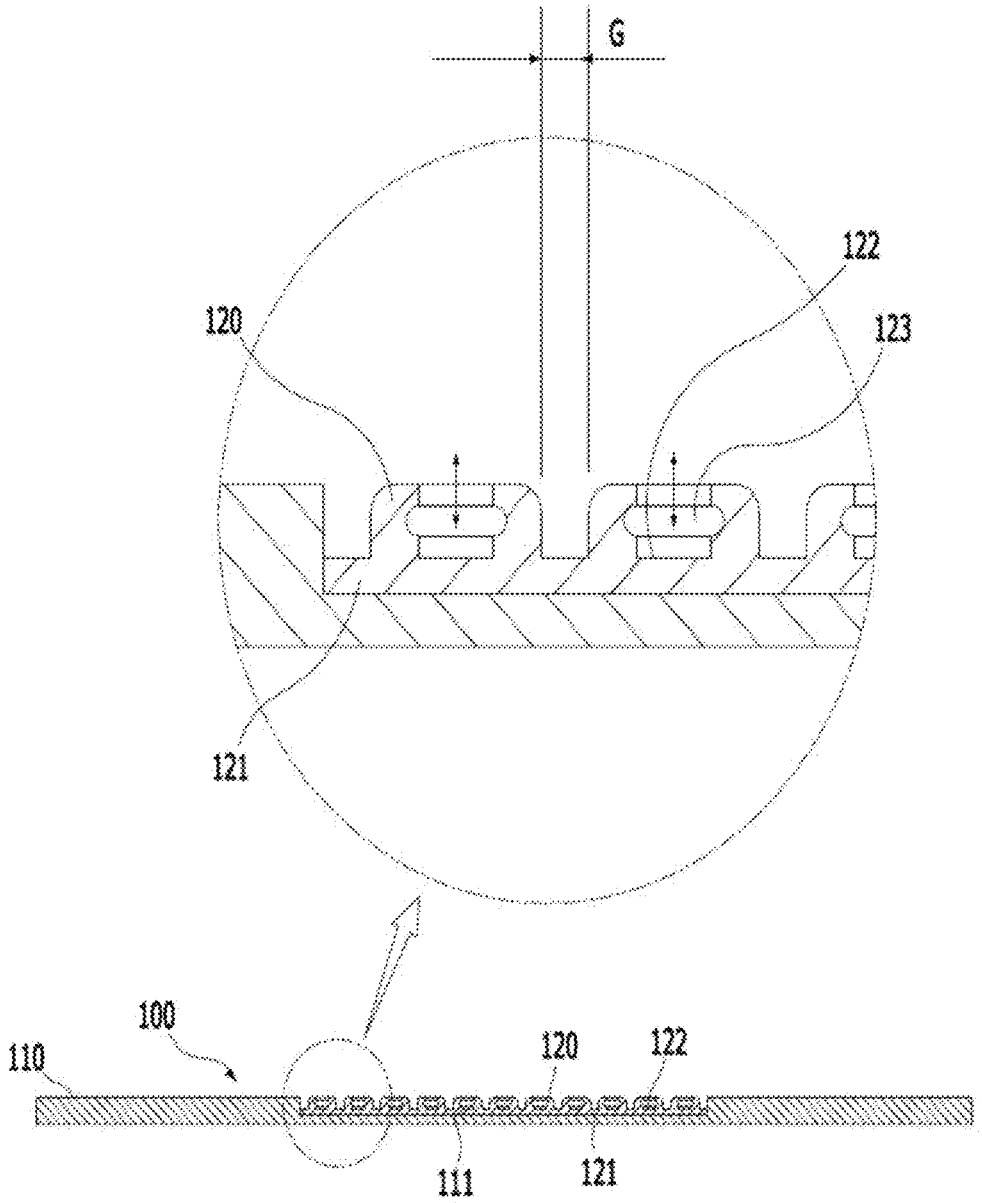

[FIG. 9]
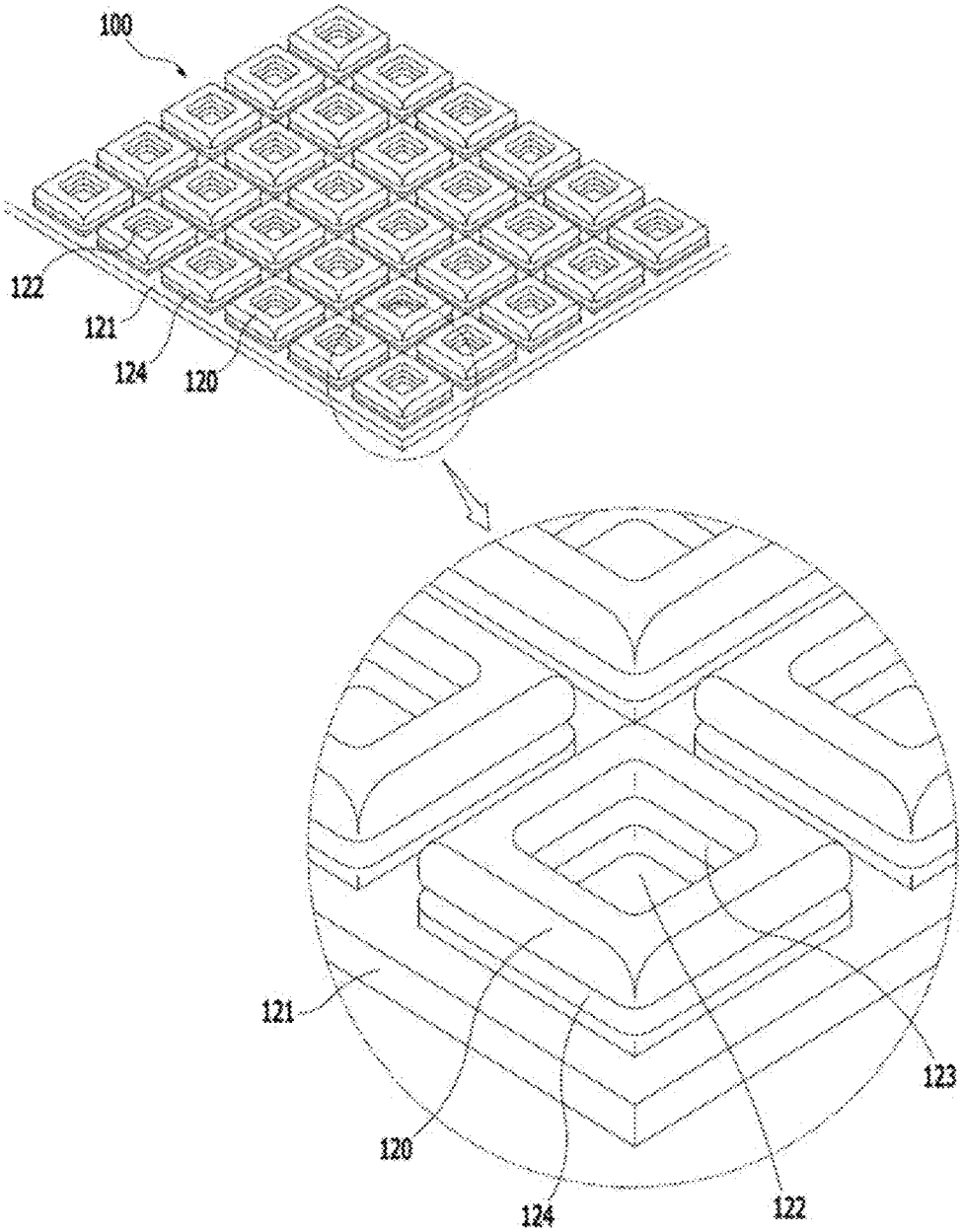

[FIG. 10]
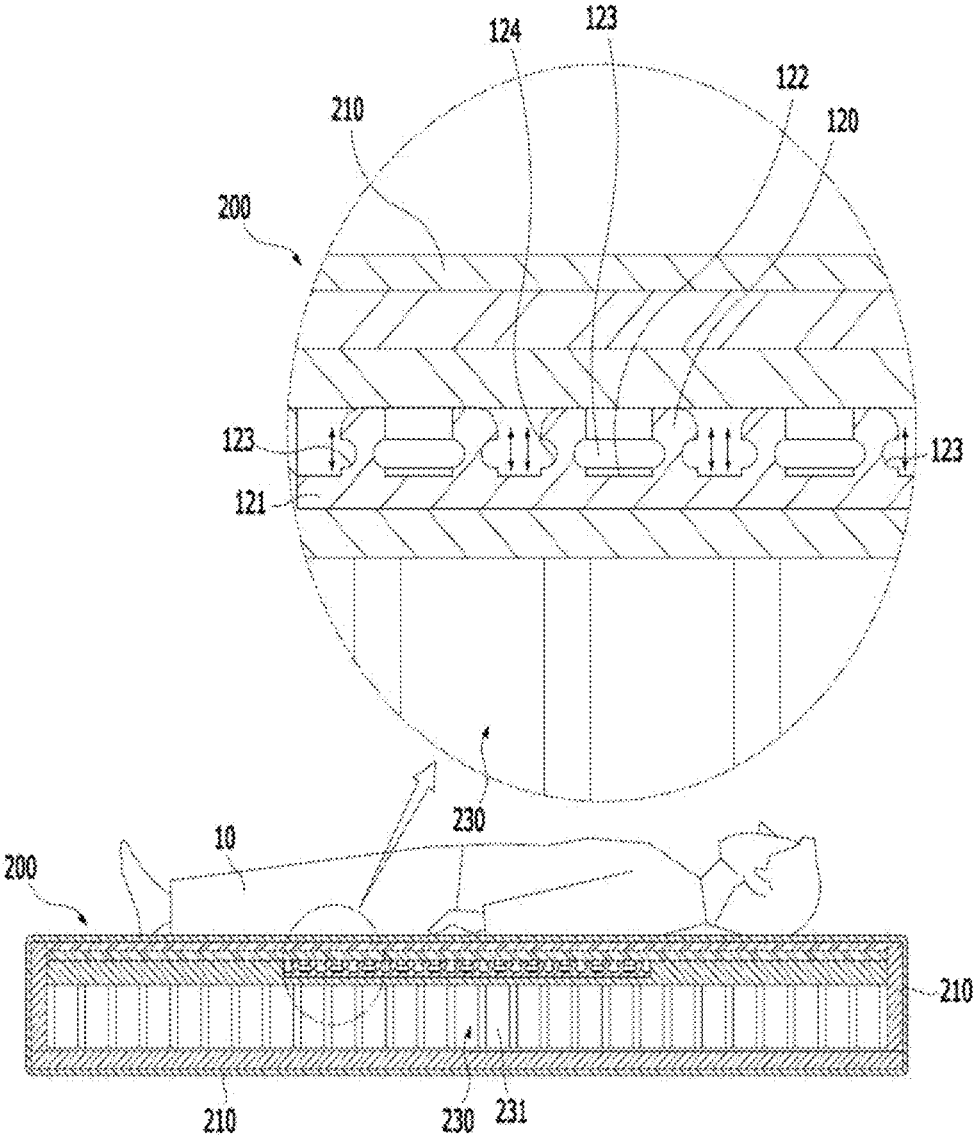

CORE SUPPORT AND MATTRESS USING THE SAME

CROSS-REFERENCE TO RELATED APPLICATION

This application claims priority to and the benefit of Korean Patent Application No. 10-2024-0115119, filed on Aug. 27, 2024, the disclosure of which is incorporated herein by reference in its entirety.

BACKGROUND

1. Field of the Invention

The present invention relates to a core support and a mattress using the same, and more specifically, to a core support capable of uniformly dispersing a pressure intensively transmitted to core parts (waist and hips) of a user, and a mattress using the same.

2. Discussion of Related Art

In general, bed mattresses are put on floors or bed frames for use, and foams, springs, and the like for buffering weights transmitted from users are installed in the mattresses.

An installation space is formed in such a bed mattress, and the bed mattress includes an outer skin on which a region in which a user can lie on an upper surface is formed, a mattress part which is provided in the installation space and provides an elastic supporting force, and an elastic part which vertically provides a compressive elastic force from under the mattress part.

However, since a supporting force of an upper surface of the conventional bed mattress is uniform, and a contact area between a human body of a user and a mattress is small, a pressure is concentrated on core parts (hips) of a user, and when the conventional bed mattress is used for a long time, there is a concern that back pain can occur due to the pressure concentrated on the core parts of the user. Accordingly, a technology capable of widely dispersing a pressure applied to core parts of a human body to minimize pain occurring in the core parts is required.

A related art of the present invention is disclosed in Korean Laid-Open Patent Publication No. 10-2018-0042969 (Apr. 27, 2018), which discloses a mattress.

SUMMARY OF THE INVENTION

Objects of the present invention are directed to providing a core support capable of uniformly dispersing a pressure intensively transmitted to a core of a user and a mattress using the same.

A core support according to one aspect of the present invention is installed in a mattress on which a human body is positioned and includes a base foam formed of an elastically deformable material and a plurality of support blocks seated on an upper surface of the base foam and formed of a vertically elastically deformable material, wherein the support blocks individually elastically support a core part of the human body positioned on the mattress.

In addition, the core support may further include a seating groove concavely formed in the upper surface of the base foam, and the support blocks may be seated on and coupled to a bottom surface of the seating groove.

In addition, the base foam may have a length in a front-rear direction, and the seating groove may be formed in a section between a front region and a rear region of the base foam.

In addition, the core support may further include a seating pad horizontally seated on the bottom surface of the seating groove and having an upper surface from which the support block protrudes, and the seating pad may be integrally formed with the support block using the same material.

In addition, each of the support blocks may have a hexahedral shape in which four sides are formed at right angles along edges, and the plurality of support blocks may be arranged to be spaced apart from each other in the front-rear direction and a lateral direction such that adjacent sides are parallel to each other.

In addition, a mattress using a core support according to another aspect of the present invention is a mattress using a core support which supports a human body and including an outer cover which is seated on an installation surface and inside which an accommodation space is formed, a guard case disposed inside the accommodation space, having a quadrangular frame shape through which a hollow vertically passes, and formed of an elastically deformable material, a plurality of elastic supports which are individually disposed in the hollow and vertically apply a compressive elastic force, a core support including a base foam supported by upper ends of the elastic supports and formed of an elastically deformable material and a plurality of support blocks seated on an upper surface of the base foam and formed of an elastically deformable material, and a cushion layer which is provided as one or more layers seated on the base foam, supports the human body, and is formed of an elastically deformable material, wherein the support blocks individually support a core part of the human body positioned on an upper surface of the mattress.

In addition, the cushion layer may include an elastic foam formed of a material having an elastic repulsive force and a memory foam seated on an upper surface of the elastic foam and formed of a material which is deformed in a shape corresponding to a shape of the human body and then restored.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a perspective view for showing a core support in a mattress using the core support according to the present invention;

FIG. 2 is an exploded perspective view for showing a base foam of the core support and a seating pad which are separated in the core support and the mattress using the same according to the present invention;

FIG. 3 is a side cross-sectional view for showing the core support in the mattress using the core support according to the present invention;

FIG. 4 is an exploded perspective view for showing components of the mattress which are separated in the core support and the mattress using the same according to the present invention;

FIG. 5 is a side cross-sectional view for showing the components of the mattress which are coupled in the core support and the mattress using the same according to the present invention;

FIG. 6 is a side cross-sectional view for showing the components of the mattress which are separated in the core support and the mattress using the same according to the present invention;

FIG. 7 is a perspective view for showing an inner deformation groove applied to a support block of the core support in the core support and the mattress using the same according to the present invention;

FIG. 8 is a side cross-sectional view for showing the inner deformation groove applied to the support block of the core support in the core support and the mattress using the same according to the present invention;

FIG. 9 is a perspective view for showing an outer deformation groove applied to the support block of the core support in the core support and the mattress using the same according to the present invention; and FIG. 10 is a side cross-sectional view for showing the outer deformation groove applied to the support block of the core support in the core support and the mattress using the same according to the present invention.

DETAILED DESCRIPTION OF EXEMPLARY EMBODIMENTS

Hereinafter, an exemplary embodiment according to the present invention will be described in detail with reference to the accompanying drawings.

Advantages and features of the present invention and methods of achieving the same should be clearly understood with reference to the accompanying drawings and the following detailed embodiments.

However, the present invention is not limited to the embodiments to be disclosed and may be implemented in various different forms. The embodiments are provided in order to fully explain the present invention and fully explain the scope of the present invention to those skilled in the art. The scope of the present invention is defined by the appended claims.

In addition, in description of the invention, when it is determined that related well-known technology and the like unnecessarily obscure the gist of the invention, detailed description thereof will be omitted.

FIG. 1 is a perspective view for showing a core support in a mattress using the core support according to the present invention, and FIG. 2 is an exploded perspective view for showing a base foam of the core support and a seating pad which are separated in the core support and the mattress using the same according to the present invention. FIG. 3 is a side cross-sectional view for showing the core support in the mattress using the core support according to the present invention, FIG. 4 is an exploded perspective view for showing components of the mattress which are separated in the core support and the mattress using the same according to the present invention, and FIG. 5 is a side cross-sectional view for showing the components of the mattress which are coupled in the core support and the mattress using the same according to the present invention.

FIG. 6 is a side cross-sectional view for showing the components of the mattress which are separated in the core support and the mattress using the same according to the present invention, FIG. 7 is a perspective view for showing an inner deformation groove applied to a support block of the core support in the core support and the mattress using the same according to the present invention, and FIG. 8 is a side cross-sectional view for showing the inner deformation groove applied to the support block of the core support in the core support and the mattress using the same according to the present invention, FIG. 9 is a perspective view for showing an outer deformation groove applied to the support block of the core support in the core support and the mattress using the same according to the present invention, and FIG. 10 is a side cross-sectional view for showing the outer deformation groove applied to the support block of the core support in the core support and the mattress using the same according to the present invention.

Referring to FIGS. 1 to 10, a core support 100 according to one embodiment of the present invention is a support installed in a mattress 200, which supports a human body 10, and includes a base foam 110 and a plurality of support blocks 120.

The base foam 110 may be horizontally installed in the mattress 200 and formed of a material which is compressively deformed by a pressure applied from above and elastically restored to an original shape when the pressure is not transmitted. In this case, the base foam 110 may be formed of a material having an elastic force such as a sponge.

In addition, the base foam 110 may have a hexahedral shape in which four outer side surfaces are formed at right angles along edges thereof and an upper surface and a lower surface are horizontally formed and may have a length in a front-rear direction to support the human body 10 of the user from below.

In addition, a seating groove 111 into which the support blocks 120 and a seating pad 121, which will be described below, are inserted may be formed in the upper surface of the base foam 110. The seating groove 111 may be formed in a section between a front region and a rear region of the base foam 110, and the seating groove 111 may be open toward two sides of the base foam 110.

That is, when the user lies on the upper surface of the base foam 110, core parts (the waist and hips) of the user are positioned on the seating groove 111, a lower part and an upper part of the user may be positioned on the front region and the rear region, respectively, and the core parts of the user may be elastically supported by the support blocks 120 coupled to the seating groove 111.

The support blocks 120 are blocks for supporting the core parts (waist and hips) of the human body 10 and are seated on and coupled to a bottom surface of the seating groove 111, and the plurality of support blocks 120 individually support the core parts and are formed of an elastic material to be compressed downward by the pressure applied from above and elastically restored upward.

In addition, each of the support blocks 120 may have a hexahedral shape in which four sides are formed at right angles along edges thereof, and the plurality of support blocks 120 may be arranged to be spaced apart from each other in the front-rear direction and a lateral direction such that adjacent sides are parallel to each other, and gaps G are formed between the support blocks 120.

That is, since the plurality of support blocks 120 are arranged to be spaced apart from each other, the support blocks 120 may be individually compressed and elastically restored and may support the core part of the human body at different levels, and since the plurality of support blocks 120 individually support the core part at the different locations, the pressure applied to the core part can be widely dispersed.

In addition, the core support 100 may further include the seating pad 121 which is horizontally seated on the bottom surface of the seating groove 111 and in which the support blocks 120 protrude from an upper surface. The seating pad 121 may be integrally formed with the support blocks 120 using the same material, and an edge of the seating pad 121 may have a shape corresponding to the seating groove 111.

In the seating pad 121, four sides may be formed along edges at the same angle, the upper surface and a lower surface may be horizontally formed, and the lower surface of the seating pad 121 may be horizontally seated on the bottom surface of the seating groove 111. Although not illustrated in the drawings, the bottom surface of the seating groove 111 and a bottom surface of the seating pad 121 may be attached by an adhesive material that is harmless to the human body.

In addition, the seating pad 121 and the support block 120 may be formed of a polymer gel, and the support block 120 formed of the polymer gel may have superior characteristics in terms of pressure dispersion and durability and is not easily deformed or damaged even when repeatedly compressed and restored.

That is, since the gaps G are formed between the support blocks 120, the support blocks 120 may be individually compressed by the pressure applied from above, and since the plurality of support blocks 120 are individually compressed, the support blocks 120 may support the core part of the human body 10 having a curved surface at the corresponding levels.

As illustrated in FIGS. 7 to 10, the mattress using the core support according to one embodiment of the present invention may further include an inner space 122 concavely formed in an upper surface of the support block 120, an inner deformation groove 123 concavely formed in an inner side surface of the inner space 122 and horizontally extending along the inner side surface of the inner space 122, and an outer deformation groove 124 concavely formed along an edge of the support block 120 and horizontally extending along the edge of the support block 120.

The inner deformation groove 123 and the outer deformation groove 124 may be portions compressed downward when the pressure is applied from above the support block 120 and may be concavely formed to be vertically curved. That is, a length which allows a width of the support block 120 to decrease in a vertical direction and the upper surface of the support block 120 to be compressed when a weight of the human body 10 is applied toward a lower surface of the support block 120 may be secured, and a vertical height of the support block 120 corresponding to a shape of the human body of the user may be secured.

As a result, in the present invention, since the pressure intensively transmitted to the core part (waist and hips) of the user can be dispersed, back pain of the user can be relieved, since the mattress can be deformed in a shape corresponding to the core parts of the user, a comfortable posture can be maintained, and since air permeability of a portion in contact with the core part can be secured, the user can comfortably use the mattress.

Hereinafter, a mattress using a core support according to a second embodiment of the present invention will be described below with reference to FIGS. 4 to 10.

The mattress using the core support according to the second embodiment of the present invention may be a mattress using a core support which supports a human body 10 and may include an outer cover 210, a guard case 220, a plurality of elastic supports 230, a core support 100, and a cushion layer 240.

A lower surface of the outer cover 210 may be seated on an installation surface, an upper surface thereof may come into contact with the human body, an accommodation space into which components that will be described below are inserted may be formed inside the outer cover 210, and the outer cover 210 may be manufactured of a material (such as fiber) that is harmless when in contact with the human body.

In this case, the outer cover 210 may have a hexahedral shape in which four outer side surfaces are formed at right angles along edges thereof and the upper surface and the lower surface are horizontally formed and may have a length in a front-rear direction to support the human body 10 of the user from below.

The guard case 220 may be disposed in the accommodation space, may have a quadrangular frame shape through which a hollow vertically passes, and may be formed of an elastically deformable material. In this case, the guard case 220 may have the quadrangular frame shape of which outer side surfaces are formed at right angles, and the outer side surfaces of the guard case 220 may be in close contact with an inner side surface of the accommodation space.

In addition, the guard case 220 may be formed of a resin-based foam material having a high hardness, the guard case 220 may be formed of a polyurethane (PU) or the like, and a bottom member closing a lower side of the hollow may be further coupled to a lower portion of the guard case 220. In this case, the bottom member may have a quadrangular panel shape of which edges are formed at right angles, and lower ends of the elastic supports 230, which will be described below, may be seated on an upper surface of the bottom member.

Like the support blocks 120, the elastic supports 230 may be supports which individually elastically support a lower surface of the base foam 110, may be vertically disposed in the hollow of the guard case 220, may be located at different locations close to but spaced apart from each other so that each can be individually compressed and extended, and may vertically apply a compressive elastic force to elastically support the lower surface of the base foam 110 which will be described below.

More specifically, each of the elastic supports 230 may include an outer skin 231 inside which an installation space is formed and a spring 232 which is provided inside the outer skin 231 and vertically applies a compressive elastic force, and the spring 232 may have a coil spring shape which may be vertically compressed and extended.

Since the elastic supports 230 are horizontally spaced apart from each other, the elastic supports 230 may be individually compressed and extended by a pressure applied from above, and since the plurality of elastic supports 230 are individually compressed and extended, the plurality of elastic supports 230 may support a core part of the human body 10 having a curved surface accordingly. That is, since the plurality of elastic supports 230 are compressed in a shape corresponding to a shape of the human body, the plurality of elastic supports 230 can support the human body in a comfortable posture.

In addition, since the guard case 220 supports edges of the elastic supports 230, shaking of the elastic supports 230 may be minimized, and since the guard case 220 is formed of the resin-based foam material having the high hardness, stability of a side surface of the mattress can be improved.

The core support 100 may be a support installed on the elastic supports 230 and may include the base foam 110 seated on the elastic supports 230 and a plurality of support blocks 120 which are provided on an upper surface of the base foam 110 and individually support the cushion layer 240 which will be described below, and the base foam 110 may be horizontally seated on the elastic supports 230. In this case, the base foam 110 may be formed of a sponge or the like having an elastic force.

In addition, the base foam 110 may have a hexahedral shape in which four outer side surfaces are formed at right angles along edges thereof and the upper surface and the lower surface are horizontally formed and may have a length in the front-rear direction to support the human body 10 of the user from below.

In addition, a seating groove 111 into which the support blocks 120 and a seating pad 121, which will be described below, are inserted may be concavely formed in the upper surface of the base foam 110. The seating groove 111 may be formed in a section between a front region and a rear region of the base foam 110, and the seating groove 111 may be open toward two sides of the base foam 110.

That is, when the user lies on the upper surface of the base foam 110, a core part (the waist and hips) of the user may be positioned on the seating groove 111, an upper part and a lower part of the user may be positioned on the front region and the rear region, respectively, and the core part of the user may be elastically supported by the support blocks 120 coupled to the seating groove 111.

The support blocks 120 are blocks for supporting the core part (waist and hips) of the human body 10 and are seated on and coupled to a bottom surface of the seating groove 111, and the plurality of support blocks 120 individually support the core part and are formed of an elastic material to be compressed downward by the pressure transmitted through upper surfaces of the outer covers 210 and the cushion layer 240 or elastically restored upward.

In addition, each of the support blocks 120 may have a hexahedral shape in which four sides are formed at right angles along edges thereof, and the plurality of support blocks 120 may be arranged to be spaced apart from each other in the front-rear direction and a lateral direction such that adjacent sides are parallel to each other, and gaps G are formed between the support blocks 120.

That is, since the plurality of support blocks 120 are arranged to be spaced apart from each other, the support blocks 120 may be individually compressed and elastically restored and may support the core parts of the human body 10 at different levels, and since the plurality of support blocks 120 support the core part at different locations and corresponding levels, the pressure applied to the core parts can be widely dispersed.

In addition, the core support 100 may further include the seating pad 121 horizontally seated on the bottom surface of the seating groove 111 and having an upper surface from which the support blocks 120 protrude. The seating pad 121 may be integrally formed with the support blocks 120 using the same material, and an edge of the seating pad 121 may have a shape corresponding to the seating groove 111.

In the seating pad 121, four sides may be formed along edges at the same angle, the upper surface and a lower surface may be horizontally formed, and the lower surface of the seating pad 121 may be horizontally seated on the bottom surface of the seating groove 111. Although not illustrated in the drawings, the bottom surface of the seating groove 111 and a bottom surface of the seating pad 121 may be attached by an adhesive material that is harmless to the human body.

In addition, the seating pad 121 and the support block 120 may be formed of a polymer gel, and the support block 120 formed of the polymer gel may have superior characteristics in terms of pressure dispersion and durability and is not easily deformed and damaged even when repeatedly compressed and restored.

That is, since the gaps G are formed between the support blocks 120, the support blocks 120 may be individually compressed by the pressure applied from above, and since the plurality of support blocks 120 are individually compressed, the support blocks 120 may support the core parts of the human body 10 having the curved surface accordingly.

The cushion layer 240 may be provided as one or more layers seated on the base foam 110, the outer cover 210 may cover an upper surface of the cushion layer 240, and when the user is positioned on the upper surface of the outer cover 210, the weight of the user may be transmitted to the cushion layer 240.

In this case, the cushion layer 240 may include an elastic foam 241 horizontally seated on the upper surface of the base foam 110 and formed of a material having a high elastic repulsive force and a memory foam 242 seated on an upper surface of the elastic foam 241 and formed of a material which may be deformed in a shape corresponding to the shape of the human body 10 and then restored.

The elastic foam 241 may have a hexahedral shape in which four outer side surfaces are formed at right angles along edges thereof and the upper surface and a lower surface are horizontally formed and may have a length in the front-rear direction to support the human body 10 of the user from below.

The memory foam 242 may be formed of a foam material of which a deformed shape is restored to an original shape when a physical force is removed, deformed in a corresponding shape while compressed downward by the weight of the human body of the user, and restored to the original shape when the weight is removed.

In addition, the memory foam 242 may have a hexahedral shape in which four outer side surfaces are formed at right angles along edges thereof and an upper surface and a lower surface are horizontally formed and may have a length in the front-rear direction to support the human body 10 of the user from below.

As illustrated in FIGS. 7 to 10, the mattress using the core support according to one embodiment of the present invention may further include an inner space 122 concavely formed in the upper surface of the support block 120, an inner deformation groove 123 concavely formed in an inner side surface of the inner space 122 and horizontally extending along the inner side surface of the inner space 122, and an outer deformation groove 124 concavely formed along an edge of the support block 120 and horizontally extending along the edge of the support block 120.

The inner deformation groove 123 and the outer deformation groove 124 may be portions compressed downward when the pressure is applied from above the support block 120 and may be concavely formed to be vertically curved. That is, a length which allows a width of the support block 120 to be decreased in a vertical direction and the upper surface of the support block 120 to be compressed when a weight of the human body 10 is applied toward the lower surface of the support block 120 may be secured, and a vertical height of the support block 120 corresponding to the shape of the human body of the user may be secured.

As a result, in the present invention, since the pressure intensively transmitted to the core parts (waist and hips) of the user can be dispersed, back pain of the user can be relieved, since the plurality of support blocks are deformed to have heights corresponding to the core part of the user, a comfortable posture of the human body can be maintained, and since air permeability can be secured to prevent moisture from gathering in a portion in contact with the core part, the user can comfortably use the mattress.

The present invention has effects that back pain of a user can be relieved because a pressure intensively transmitted to core parts (waist and hips) of the user can be dispersed, a comfortable posture of a human body can be maintained because a plurality of support blocks are deformed to have heights corresponding to the core part of the user, and the user can comfortably use a mattress because air permeability can be secured to prevent moisture from gathering in a portion in contact with the core parts.

Although specific embodiments of the core support and the mattress using the same according to the present invention have been described above, it should be clear that various modifications may be made thereto without departing from the scope of the present invention.

Therefore, the scope of the present invention is defined not by the described embodiments but by the appended claims and encompasses equivalents that fall within the scope of the appended claims.

That is, the above-described embodiments should be considered in a descriptive sense only and not for purposes of limitation. The scope of the present invention is defined not by the detailed description but by the appended claims, and encompasses all modifications and alterations derived from meanings and the scope and equivalents of the appended claims.

What is claimed is:

1. A core support which is installed in a mattress on which a human body is configured to be positioned, the core support comprising:

a base foam formed of an elastically deformable material; and a plurality of support blocks formed of a vertically elastically deformable material, wherein the support blocks are configured to individually elastically support a core part of the human body positioned on the mattress, wherein a seating groove is concavely formed in the upper surface of the base foam, wherein the support blocks are seated on and coupled to a bottom surface of the seating groove, wherein each of the support blocks has a hexahedral shape in which four sides are formed at right angles along edges, wherein the plurality of support blocks are arranged to be spaced apart from each other in a front-rear direction and a lateral direction such that adjacent sides are parallel to each other, wherein each of the support blocks includes an inner space concavely formed in an upper surface of the support block, an inner deformation groove concavely formed in an inner side surface of the inner space and horizontally extending along the inner side surface of the inner space, and an outer deformation groove concavely formed along the edge of the support block and horizontally extending along the edge of the support block, wherein the inner deformation groove and the outer deformation groove are concavely formed to be vertically curved, wherein the base foam has a length in the front-rear direction, wherein the seating groove is formed in a mid-region between a front region and a rear region of the base foam, wherein the seating groove is open toward both sides of the base foam, and wherein each of the support blocks is individually compressible and elastically restorable, and the support blocks are configured to support the human body at the same or different heights at different positions.

2. The core support of claim 1, further comprising a seating pad horizontally seated on the bottom surface of the seating groove and having an upper surface from which the support block protrudes, wherein the seating pad is integrally formed with the support block using the same material.

3. A mattress using a core support which is configured to support a human body, the mattress comprising:

an outer cover which is seated on an installation surface and inside which an accommodation space is formed;

a guard case disposed inside the accommodation space, having a quadrangular frame shape through which a hollow vertically passes, and formed of an elastically deformable material;

a plurality of elastic supports which are individually disposed in the hollow and vertically apply a compressive elastic force;

a core support including a base foam supported by upper ends of the elastic supports and formed of an elastically deformable material and a plurality of support blocks formed of an elastically deformable material; and a cushion layer which is provided as one or more layers seated on the base foam, is configured to support the human body, and is formed of an elastically deformable material, wherein the support blocks are configured to individually support a core part of the human body positioned on an upper surface of the mattress, wherein the cushion layer includes an elastic foam formed of a material having an elastic repulsive force and a memory foam seated on an upper surface of the elastic foam and formed of a material which is configured to be deformed in a shape corresponding to a shape of the human body and then restored, wherein a seating groove is concavely formed in the upper surface of the base foam, wherein the support blocks are seated on and coupled to a bottom surface of the seating groove, wherein each of the support blocks has a hexahedral shape in which four sides are formed at right angles along edges, wherein the plurality of support blocks are arranged to be spaced apart from each other in a front-rear direction and a lateral direction such that adjacent sides are parallel to each other, wherein each of the support blocks includes an inner space concavely formed in an upper surface of the support block, an inner deformation groove concavely formed in an inner side surface of the inner space and horizontally extending along the inner side surface of the inner space, and an outer deformation groove concavely formed along the edge of the support block and horizontally extending along the edge of the support block, wherein the inner deformation groove and the outer deformation groove are concavely formed to be vertically curved, wherein the base foam has a length in the front-rear direction, wherein the seating groove is formed in a mid-region between a front region and a rear region of the base foam, wherein the seating groove is open toward both sides of the base foam, and wherein each of the support blocks is individually compressible and elastically restorable, and the support blocks are configured to support the human body at the same or different heights at different positions.

* * * * *